United States Patent [19]

Williams et al.

[11] Patent Number: 5,069,310

[45] Date of Patent: Dec. 3, 1991

[54] INSULATOR CLIMBING SUPPORT

[75] Inventors: Danny R. Williams, Houston; Mary A. Barron, Cypress, both of Tex.

[73] Assignee: Houston Industries Incorporated, Houston, Tex.

[21] Appl. No.: 675,135

[22] Filed: Mar. 26, 1991

[51] Int. Cl.[5] ..... E06C 7/00

[52] U.S. Cl. ..... 182/187; 182/92; 182/100; 248/231; 248/218.4

[58] Field of Search ..... 182/187, 92, 133–136, 182/9, 100; 248/230, 231, 218.4

[56] References Cited

U.S. PATENT DOCUMENTS

| | | | |
|---|---|---|---|
| 306,939 | 10/1884 | Matteson | 182/134 |
| 882,850 | 3/1908 | Troell | 182/187 |
| 1,812,117 | 6/1931 | Rastetter | 248/230 |
| 2,086,280 | 7/1937 | Matter | 182/92 Y |
| 2,428,391 | 10/1947 | Smith . | |
| 3,042,736 | 7/1962 | Salisbury . | |
| 3,202,450 | 8/1965 | Servis . | |
| 3,497,171 | 2/1970 | Farmer et al. . | |
| 3,561,712 | 2/1971 | Newsome . | |
| 3,824,676 | 7/1974 | Ebert . | |
| 4,301,891 | 11/1981 | Harbian . | |
| 4,607,725 | 8/1986 | Brinkmann et al. . | |
| 4,754,841 | 7/1988 | Koffski . | |

FOREIGN PATENT DOCUMENTS

| | | | |
|---|---|---|---|
| 80488 | 4/1895 | Fed. Rep. of Germany | 182/134 |

*Primary Examiner*—Alvin C. Chin-Shue

*Attorney, Agent, or Firm*—Pravel, Gambrell, Hewitt, Kimball, & Krieger

[57] ABSTRACT

A support is provided for fitting over one or more insulating disks in electrical power distribution equipment. The support has a collar which fits about the disk or disks and includes structure which fits onto one of the insulator disks for support. Foot support struts extend outwardly from the collar for support of a climbing crew member's feet.

14 Claims, 2 Drawing Sheets

INSULATOR CLIMBING SUPPORT

BACKGROUND OF INVENTION

1. Field of Invention

The present invention relates to a support for climbing a stacking of electrical power distribution insulation disks.

2. DESCRIPTION OF PRIOR ART

It has sometimes been necessary when working on a power line or other electrical power distribution equipment for a crew member to climb above a normal support level. Where insulator disks are present, the climber would typically use them for foot support. Even though there was a safety belt about the climber's body for support on the disks, there was still a substantial risk of foot slippage. When this occurred, the climber could fall several feet before contacting some lower structure. There was thus a potential safety risk.

So far as is known, there has been no form of climbing support for use in these situations. U.S. Pat. Nos. 3,824,676; 2,428,391; and 3,042,736 related to protective covers for insulators to prevent damage to the insulators. The structure of these covers was fitted around the insulators to protect them from damage while they were being installed or while equipment near them was being serviced. U.S. Pat. No. 3,202,450 described a tool for lifting and installing a stack of insulators onto a tower for support of electrical conductors.

U.S. Pat. Nos. 3,497,171 and 3,561,712 were directed to supports for mounting electrical equipment to utility poles. U.S. Pat. Nos. 4,754,841; 4,301,891 and 4,607,725 involved portable support structures or ladders adapted to be fitted about posts or poles for climbing purposes.

SUMMARY OF INVENTION

Briefly, the present invention provides a new and improved climbing support for climbing of a stack of insulating disks on electrical power distribution equipment. The climbing support includes a collar member which is adapted to fit about one or more of the insulator disks in the stack. The collar member is releasably mounted about the insulator disk or disks by a buckle mechanism so that it can be attached for climbing and removed for subsequent use as needed. outwardly from the collar member for supporting a climber during climbing of the insulator disk stack.

DESCRIPTION OF PREFERRED EMBODIMENT

Figure 2:
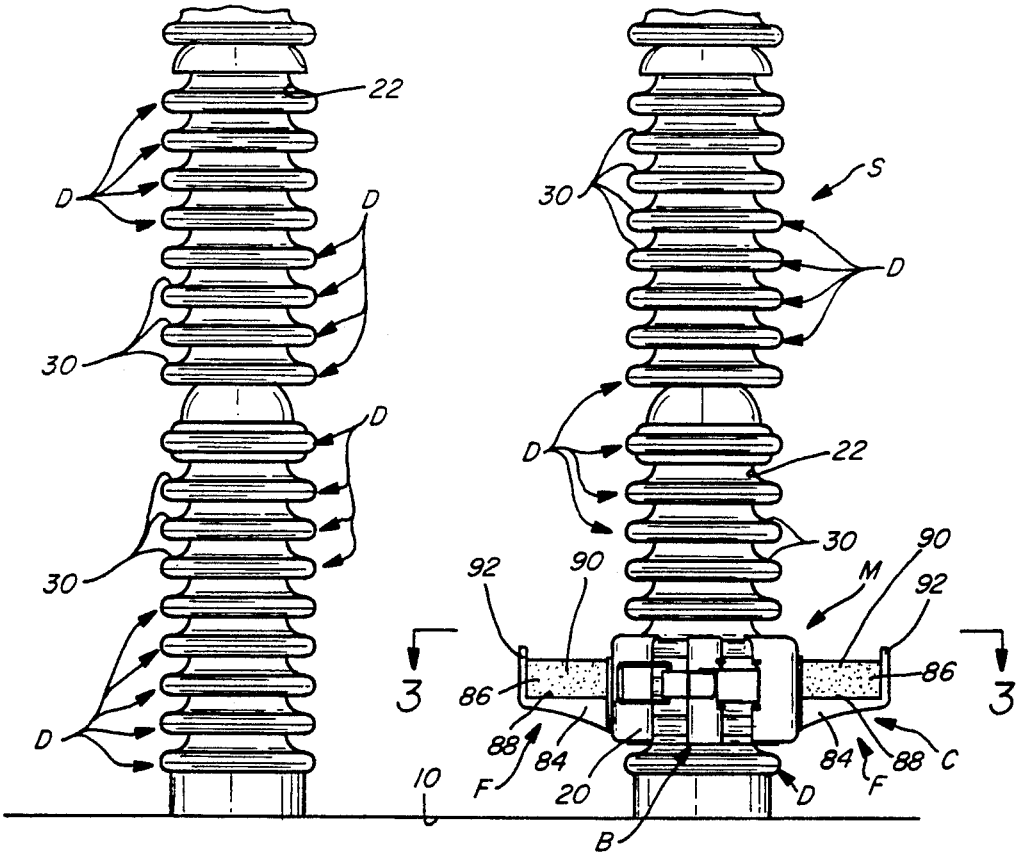
FIG. 2 is an elevation view of an insulator climbing support of the present invention mounted on one of a stacked insulator disks.

In the drawings, the letter C designates generally a climbing support or apparatus for climbing a stack S of insulator disks D mounted on or with electrical power distribution equipment. A pair of such stacks S of plural insulating disks D are shown (FIG. 2) mounted adjacent each other on a surface 10 which may be on a support beam or bar, or on an item of electrical power distribution equipment or the like. The individual insulating disks D are typically formed of a glazed ceramic material and as such are relatively smooth, causing the possibility of a climber's foot or boot slipping during climbing.

It has in the past been required for a crew member to climb above a normal support level, such as the surface 10, when working on electrical power lines or other power distribution equipment. Typically, the climber used the insulator disks for foot support, relying also for support for safety purposes on the conventional safety belt about the climber's body. Due to the material of the insulative disks D, there has been a substantial risk of foot slippage during such climbing operations. In the event of such a slippage, a climber could fall several feet, even though a safety belt were attached to the climber's body, before making contact with lower support structure.

The climbing support C includes a collar member M which is adapted to fit about one or more of the insulative disks D in the stack S. The collar member M is releasably mounted about the disk or disks D by a buckle member arrangement or mechanism B, while support for a climber's feet or boots is provided by outwardly extending foot supports F formed on or mounted with the climbing support C.

Figure 3:
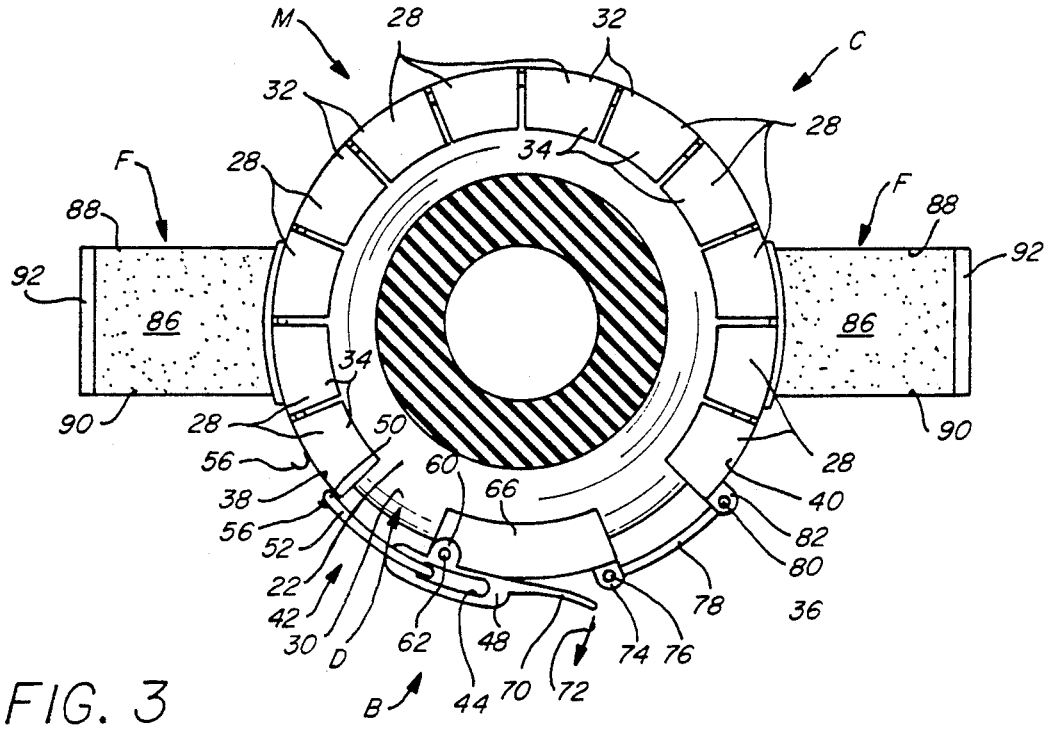
FIG. 3 is a cross-sectional view taken along the line 3–3 of FIG. 2.

The collar member M of the climbing support C is formed of a suitable strength material, such as a synthetic resin, and includes a cylindrical sleeve member 20. The cylindrical sleeve member 20 subtends in a horizontal plane an angle substantially greater than 180°, typically 270° or so, in order to enclose side portions 22 (FIG. 3) of the disk or disks D. The sleeve member 20 has a vertical extent between a lower portion 24 and an upper portion 26 determined by the number of disks D in the stack S to be enclosed within the climbing support C.

A plurality of radially inwardly extending finger members 28 are formed at, and serve as inner extensions of, the upper portion 26 of the collar member M. The finger members 28 rest on a surface 30 of a selected insulating disk D and distribute any load applied to the climbing support C about the periphery of the collar member 20.

Figure 4:
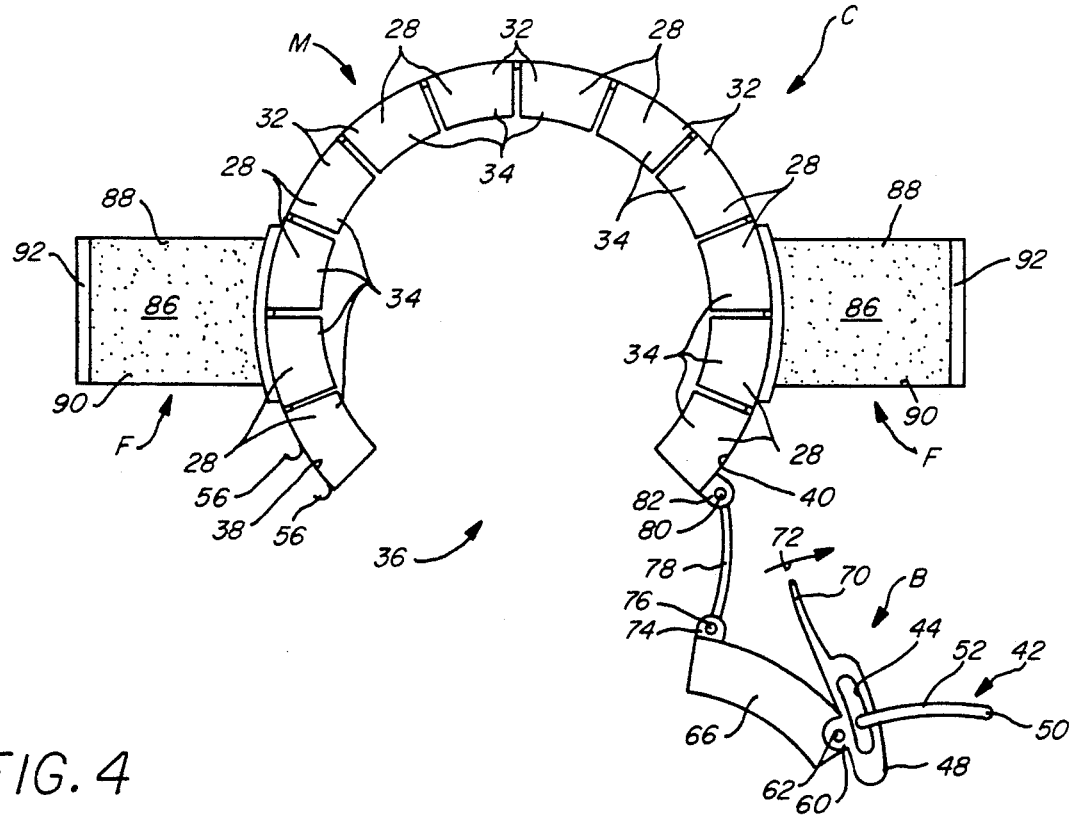
FIG. 4 is a view of the structure of FIG. 3 in an open or unlocked position.

The finger members 28 are wedge-shaped, tapering slightly inwardly from outer portions 32 to inner portions 34. In this manner, adjacent ones of the finger members 28 fit snugly against each other (FIGS. 3 and 4) in the horizontal plane to distribute the load on the climbing support C about the periphery of the insulating disk D.

Figure 1:
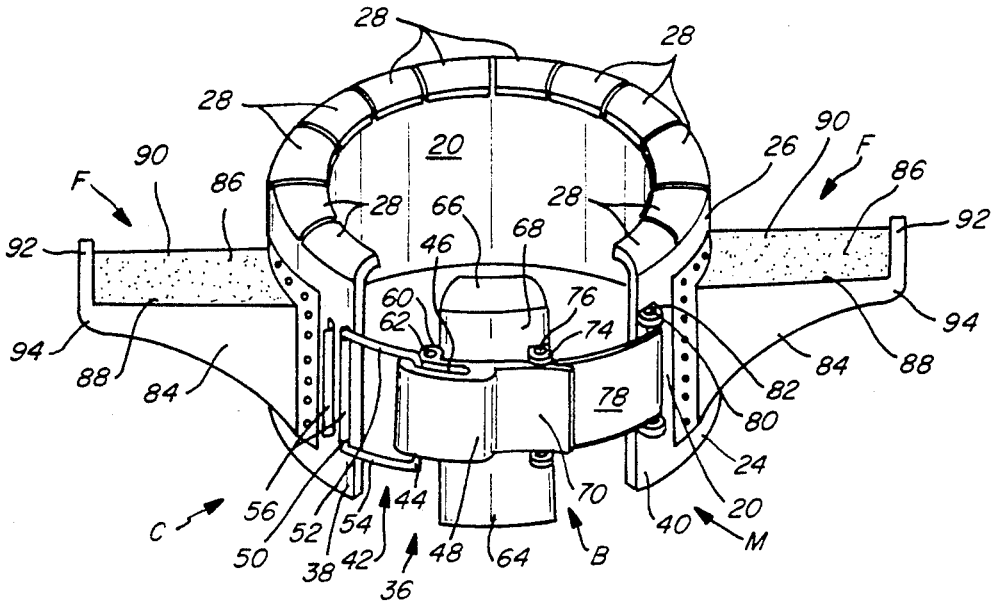
FIG. 1 is an isometric view of an insulator climbing support according to the present invention.

The cylindrical sleeve member 20 of collar member M has a gap 36 between a first side portions 38 and a second side portion 40 so that the climbing support S may be fitted over the disk D in the stack for climbing purposes. The buckle member assembly B is mounted with the sleeve member M to close the gap 36 (FIGS. 1 and 3) and secure the climbing support S in place on the disks D.

The buckle member B includes a generally rectangular buckle loop 42 which has a pivot pin 44 pivotally mounted in a mounting slot 46 formed in a buckle clasp 48. An outer connector rod or pin 50 of the buckle loop 42 is connected by buckle rods 52 and 54 to the pivot pin 44 to form the generally rectangular buckle loop 42.

The connector rod 50 is adapted to fit within any selected one of a plurality of vertically extending C-or U-shaped receptor sleeves or sockets 56 mounted on the first side portion 38 of the collar member 20 adjacent the gap 36. The particular receptor sleeve 56 chosen varies depending upon the diameter of the insulator disk D being climbed. In this manner, the relative position of the buckle member B may be adjusted with respect to the collar member M based on the size of the insulating disk D being climbed. Thus, the climbing support C of the present invention may be used with a number of varying sizes of insulative disks.

The buckle clasp 48 has a pair of connector tab members 60 mounted thereon to receive a connecting pivot rod 62 to attach the clasp 48 to a support member 64. The support member 64 is formed of a like material to the sleeve member 20 and has a radially inwardly extending finger member 66 formed at and serving as an inner extension of an upper portion 68. The finger member 66 rests on the surface 30 of the insulating disk D to bear a portion of the load being borne by the finger members 28.

The buckle clasp 48 also has a release lug or tab member 70 formed extending rearwardly from the mounting slot 46. The release lug 70 allows the buckle clasp 48 to be pivoted, as indicated by an arrow 72, between an open position (FIG. 4) and a closed position (FIGS. 1, 2, and 3) to lock and unlock the climbing support S on the disks D.

The support member 64 also has a connecting pivot tab or sleeve 74 formed thereon opposite the connector pivot 60 for receiving a pivotally mounted connector rod or pin 76 to which is mounted a connector belt or strap 78. The connector belt 78 is mounted at an opposite end from the pin 76 to a second connector pivot rod or pin 80 which is pivotally mounted in mounting tabs 82 on the side portion 40 of the collar member 20 adjacent the gap 36.

The foot support struts F may be integrally formed with the collar member M or may be separate structural items, as shown in the drawings, mounted with the collar member M. The foot support struts F extend outwardly from the sleeve member 20 of collar member M in a generally horizontal direction above support yokes or arms 84.

The support struts F have an inclined upper support surface 86 extending upwardly from the support yoke or arm 84 in a direction inclined from a lower portion 88 upwardly to an upper portion 90 with respect to the horizontal plane. The inclined upper support surface 86 serves to transfer the load of the climber's weight from the climber's feet and boots to the collar member M and therefrom onto to the insulator disk stack S.

The upper support surface 86 of the foot supports F is also preferably roughened, such as by a grained or knobby textured surface, for slip prevention protection. The foot supports F also include upwardly extending side or lateral stops 92 formed at outer ends 94 thereof. The stops 92 serve to prevent a climber's boots or shoes from slipping sidewardly off the climbing support C.

In the operation of the present invention, the collar member M is fitted onto the stack S of disks D at a desired elevation. After the finger members 28 and 66 have been properly positioned on the upper surface 30 of the disk D selected, the connector rod 50 is fitted within a selected one of the receptor sleeves 56. The release lug or tab 70 of the buckle clasp 48 is then pivoted to the locked position, locking the climbing support S in position (FIGS. 2 and 3) on the stack S of insulator climbing disks D for climbing support purposes.

Once climbing operations have been completed and the climbing support S is no longer needed for support purposes, the release tab 70 is pivoted to the open position, as indicated by the arrow 72, unlocking the climbing support S from the stack of disks D. The climbing support C then may be taken to another location and used again for climbing purposes.

Having described the invention above, various modifications of the techniques, procedures, material and equipment will be apparent to those in the art. It is intended that all such variations within the scope and spirit of the appended claims be embraced thereby.

We claim:

1. A climbing support for climbing a stack of insulator disks on electrical power distribution equipment, comprising:

a collar member adapted to fit about an insulator disk in the stack, said collar member comprising:

a cylinder sleeve extending between an upper and lower portion and adapted to enclose side portions the insulator disk;

finger members formed on said upper portion of said cylindrical sleeve extending inwardly and tapering from an outer portion to an inner portion to contact other adjacent finger members to rest on the insulator disk for support;

said collar member having a gap between side portions thereof for movement about the insulator disk;

means for releasably mounting said collar member about the insulator disk; and foot support means extending outwardly from said collar member for supporting a climber during climbing of the insulator disk.

2. The apparatus of claim 1, wherein said collar member comprises:

a collar member adapted to fit about a plurality of insulator disks in the stack.

3. The apparatus of claim 2, wherein said collar member comprises:

a cylindrical sleeve extending between an upper and a lower portion and adapted to enclose side portions of the plurality of insulator disks; and finger members formed on said upper portion of said cylindrical sleeve extending inwardly and tapering from an outer portion to an inner portion to contact other adjacent finger members to rest on one of the insulator disks for support.

4. The apparatus of claim 1, wherein said means for releasably mounting comprises:

a buckle member mounted between said side portions of said collar member for attaching said collar member on the insulator disk.

5. The apparatus of claim 4, wherein said buckle member comprises:

a buckle loop pivotally mounted with one side portion of said collar member; and a receptor sleeve selectively engageable with said buckle loop and mounted with another side portion of said collar member.

6. The apparatus of claim 5, further including:

a support member mounted with said buckle clasp, said support member comprising:

a plate member adapted to fit about the insulator disk in the stack; and a finger member formed on said plate member extending inwardly to rest on the insulator disk for support.

7. The apparatus of claim 5, further including:

a support member mounted with said buckle clasp;

a belt member movably mounting said support member to said another side portion of said collar member.

8. The apparatus of claim 4, further including:

means for adjusting the relative position of said buckle member between said side portions of said collar member.

9. The apparatus of claim 1, wherein said foot support means comprises:

a plurality of foot support strut members mounted on said collar member.

10. The apparatus of claim 1, wherein said foot support means comprises:

a plurality of foot support strut members formed with said collar member.

11. The apparatus of claim 1, wherein said foot support means comprises:

a plurality of foot support strut members having an upper support surface for engagement by the climber's feet., 12. The apparatus of claim 11, wherein:

said upper support surface of said foot support strut members has a roughened upper support surface to resist slippage of the climber's feet.

13. The apparatus of claim 1, wherein said foot support means comprises:

a plurality of generally horizontally extending foot support strut members having an upper support surface inclined to the horizontal for transfer of the climber's weight to said collar member.

14. The apparatus of claim 1, wherein said foot support means comprises:

a plurality of foot support strut members mounted on said collar member; and a stop member formed on an outer end of each of said foot support strut members from said collar member.

* * * * *